United States Patent [19]

Kokaji

[11] Patent Number: 4,654,289

[45] Date of Patent: Mar. 31, 1987

[54] METHOD FOR RECORDING AND DEVELOPING LATENT IMAGES IN MAGNETIC PRINTING APPARATUS

[75] Inventor: Norio Kokaji, Hino, Japan

[73] Assignee: Iwatsu Electric Co., Ltd., Tokyo, Japan

[21] Appl. No.: 808,852

[22] Filed: Dec. 13, 1985

[30] Foreign Application Priority Data

Feb. 15, 1985 [JP] Japan ..... 60-26432

[51] Int. Cl.[4] ..... G03G 19/00

[52] U.S. Cl. ..... 430/39

[58] Field of Search ..... 430/39; 346/74

[56] References Cited

FOREIGN PATENT DOCUMENTS 55-17382 5/1980 Japan .

60-4194 2/1985 Japan .

*Primary Examiner*—J. D. Welsh

*Attorney, Agent, or Firm*—Paul & Paul

[57] ABSTRACT

When latent images in a magnetic printing apparatus are recorded and developed, a magnetic pattern which has one direction and which has at least two magnetic transfer regions is formed at one-dot black picture regions on a recording medium. When the black picture regions have two or more dots, beside the magnetic pattern having one direction, at least one magnetized pattern having the other direction is formed therein. A white picture region is formed by a magnetized pattern which is longer than the magnetized pattern in the black picture region and which has the other direction. The developing magnetic field is formed in the same direction as that of the other direction. A print having high resolution can be obtained by mutual action between the developing field and the magnetic field generated by the magnetized pattern for the recording.

4 Claims, 6 Drawing Figures

METHOD FOR RECORDING AND DEVELOPING LATENT IMAGES IN MAGNETIC PRINTING APPARATUS

BACKGROUND OF THE INVENTION

1. Field of the Invention

The present invention relates to a method for recording and developing and latent images in a magnetic printing apparatus.

2. Description of the Related Art

It has been propersed to apply a weak magnetic field to develop latent images in a magnetic printing apparatus, as disclosed in Japanese Examined Patent Publication (Kokoku) No. 55-17382 and Japanese Examined Utility Model Publication (Kokoku) No. 54-18336. To use this development method, is important to suitably set the magnetization of the recording medium and the developing magnetic field. If this relation is mistaken, the resolution of the print is lowered.

SUMMARY OF THE INVENTION

An object of the present invention is to provide a method for recording and developing latent images in a magnetic printing apparatus in which a print having a high resolution can be obtained.

This object can be achieved by a method for recording and developing latent images in a magnetic printing apparatus including the steps of forming, at one-dot black picture regions on a recording medium, a magnetized pattern of one direction having at least two magnetic transfer regions; forming, at a two or more dot black picture regions, beside the magnetized pattern of one direction, at least one magnetized pattern having the other direction; forming, at white picture regions on the recording medium, a magnetized pattern which is longer than the magnetized pattern in the black picture regions and which has the other direction; the direction of the developing magnetic field being the same as the other direction.

In the developing method as mentioned above, the directions of the magnetic field by which the magnetized pattern is generated and the direction of the developing magnetic field are specially designated for a high resolution print.

BRIEF DESCRIPTION OF THE DRAWINGS

Further features and advantages of the present invention will be apparent from the ensuing description with reference to the accompanying drawings, in which.

DESCRIPTION OF THE PREFERRED EMBODIMENTS

Figure 1:
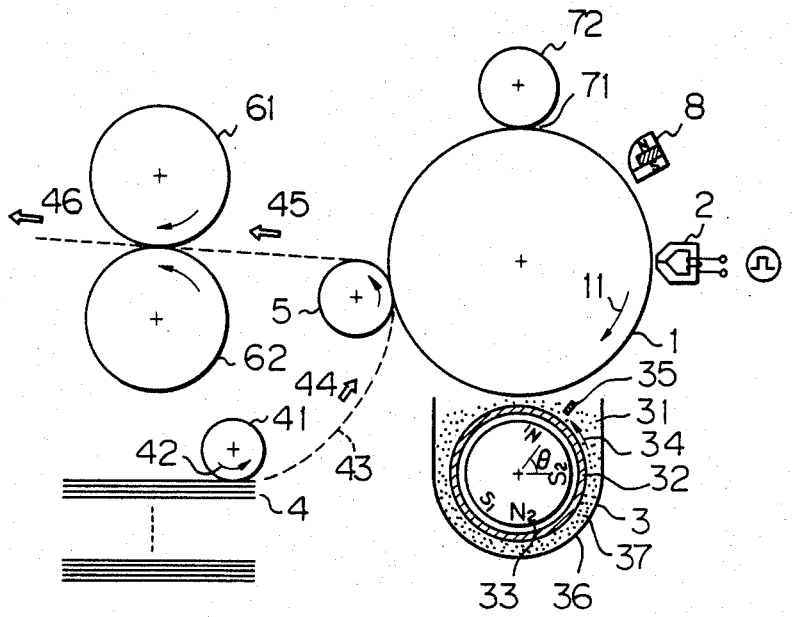
FIG. 1 is a diagram of an embodiment of the present invention.

Hereinafter, the embodiments of the present invention will be explained in detail referring to the drawings.

FIG. 1 shows an embodiment of the present invention. In FIG. 1, a recording drum 1 moves in the direction shown by the arrow 11. A magnetic latent image is recorded on the recording drum by a recording head 2. The magnetic latent image is developed by a developer 3, and a magnetic toner 31 attracted to the magnetic drum 1. Next, recording paper 4 is fed out by a feeding roller 41 and is supplied along the path shown by broken line 43 to a direction shown by the arrow 44. The toner on the recording drum 1 is transferred on the paper by the transfer roller 5. Next, the paper is sent along the direction shown by the arrow 45 via fixing rollers 61, 62 so as to fix the toner image. Then, the paper is discharged in the direction shown by the arrow 46. The toner not transferred is removed from the recording drum 1 by cleaner 72. Prior to the next recording of a latent image, an erasing head 8 operates to erase the prior latent image.

In FIG. 1, the developer 3 comprises a sleeve 32 rotating in the direction shown by the arrow 34, a developer magnet 33 fixed in the sleeve 32, a toner height restricting plate 35, a housing 36, and toner 37. $N_1$, $S_1$, $N_2$, $S_2$, in the developer magnet indicate under dual magnets.

Figure 2:
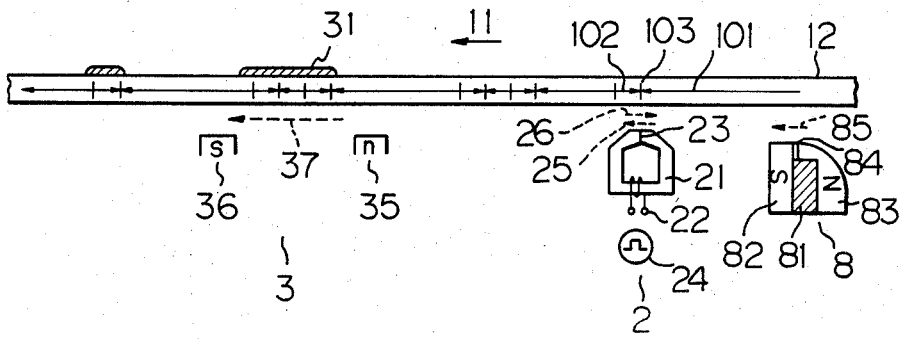
FIG. 2 is a diagram showing the relationships between the recording drum and its periphery a linear model according to the present invention.

FIG. 2 shows the relationships between the drum 1, the erasing head 8, the recording head 2, and the developer 3. The recording drum 1 moves in the direction of the arrow 11. A recording medium 12 of the recording drum 1 is first magnetized in one direction by the erasing head 8. The erasing head 8 is formed, for example, in such a manner that permanent magnet 81 is held between soft magnetic material holders 82 and 83. A joint gap portion 84 is formed at the position which is nearest to the recording medium 12. In the state shown in.FIG. 2, a left-oriented magnetic field shown by the arrow 85 is generated from the N pole to the S pole of the permanent magnet 81 from the joint gap portion 84. When the recording medium 12 passes near the joint gap portion 84, the recording medium is magnetized in the left direction 101. When the erasing head 8 is not functioning, the joint gap portion 84 is kept away from the recording medium (see Examined Utility Model Publications No. 56-3726). Of course, a winding-type erasing head may be used in place of the permanent magnet type.

Next, the magnetic latent image corresponding to the image signals is recorded by the recording head 2. The head 2 is formed by a core 21, a coil 21, and a joint gap portion 23. The direction of the recording magnetic field generated externally from the joint gap portion 23 is, due to the polarity of the pulse current 24 supplied to the coil 22, sometimes the direction 25, which is the same as the field 85 generated from the erasing head, or sometimes the direction 26. When a recording magnetic field 26 of the reverse direction is generated, the recording medium 12 is magnetized in the right direction 102. A magnetizing transfer region 103 is formed at the border between the left-oriented magnetized pattern 101 and the right-oriented magnetizing pattern 103.

Next, at the developer 3, there is a comparatively weak left-oriented magnetic field 37 due to the magnets 35 and 36 near the recording medium 12. By the aid of this magnetic field 37, the magnetic toner 31 is attracted to the desired portion.

Figure 3:
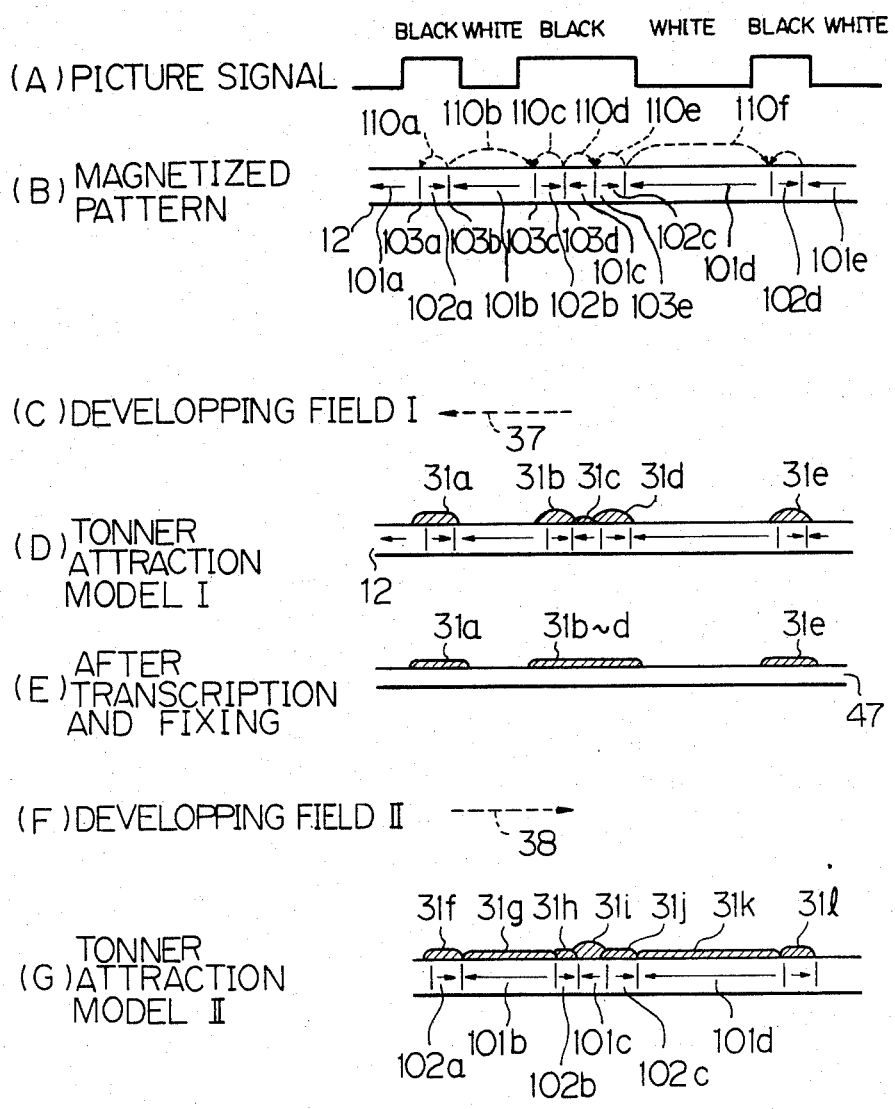
FIG. 3 is a diagram of the relationship between the picture signal, a magnetized pattern, and the developing magnetic field in recording and the developing method of the present invention.
Figure 4:
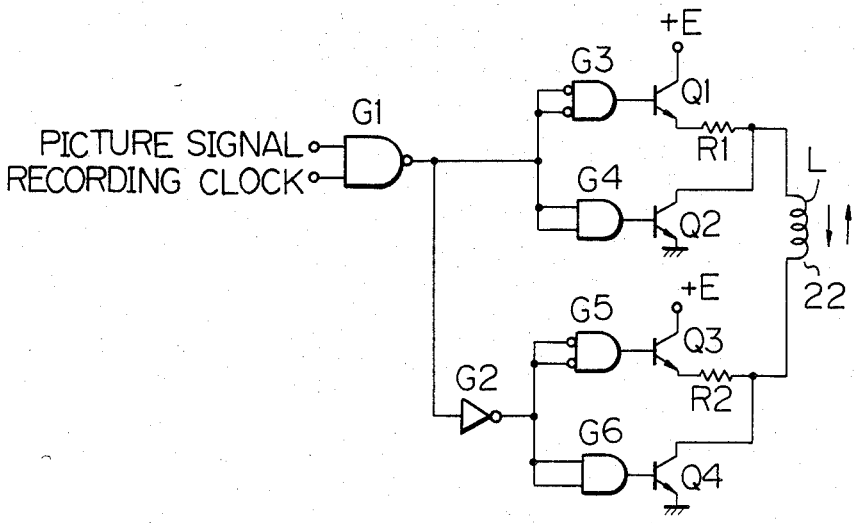
FIG. 4 shows a circuit for recording the latent image in the method according to the present invention.
Figure 5:
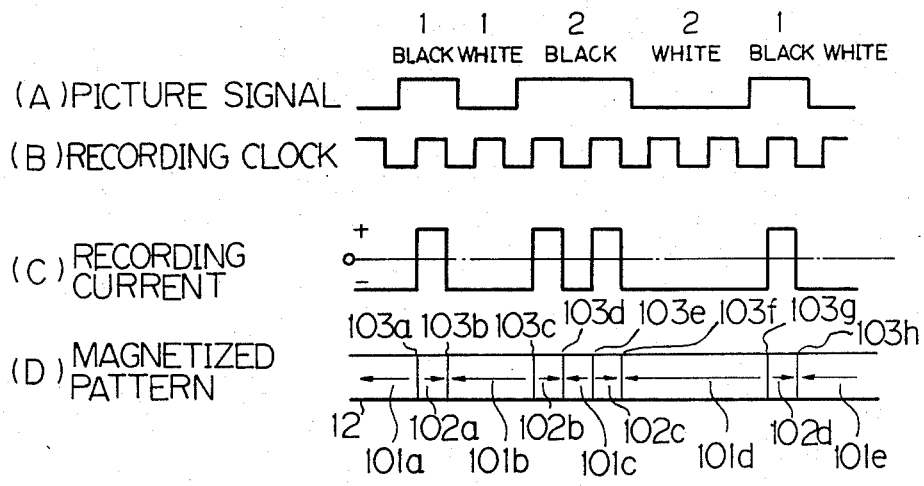
FIG. 5 is a time chart for explaining the function of the circuit shown in FIG. 4.

Next, the explanation will be given of why the developing magnetic field 37, one recording magnetic field 25, and the erasing magnetic field 85 have the same direction and the other recording magnetic field 26 has the opposite direction. For the picture signal shown in FIG. (3A), the recorded magnetized pattern is assumed as shown in FIG. 3(B). An example of a latent image recording circuit which records such a picture is shown in FIG. 4. The timing chart thereof is shown in FIG. 5. The explanation will be given concerning an example where a picture signal sequentially changes from one black dot, to one white dot, two black dots, two white dots, one black dot, .... A recording clock is made such that one dot, for example, corresponds to one period (FIG. 5(A), (B)).

The picture signal and the recording clock are applied to a NAND gate $G_1$ (FIG. 4) so as to output a logical sum. When AND of the two signals is formed so that the output of $G_1$ becomes logical "0" (low level), the output of the gate $G_3$ becomes logical "1" (high level), and the driving transistor $Q_1$ is placed to the on state. The output of a gate $G_4$ becomes logical "0" (low level) and a driving register $Q_2$ is placed to the off state. The output logical "0" of the NAND gate $G_1$ makes the output of an inverter $G_2$ logical "1" (high level), the output of a gate $G_5$ is made logical "0" (low level), the transistor $Q_3$ is placed in the off state, and the output of a gate $G_6$ is made logical "1" (high level), so that the transistor $Q_4$ enters the on state. Then, current flows from a power source +E, via $Q_1$, a resistor $R_1$ a coil L (22), and $Q_4$ to the ground. At this time, a magnetic field is generated from a joint gap portion 23 of the head to a direction shown by 26 (FIG. 5(D)), then a magnetized pattern 102*a* (FIG. 5(D)) is recorded on the recording medium 12.

Next, when the logical sum is not formed by them, the output of the gate $G_1$ becomes logical "1" (high). Contrary to the above-mentioned case, the transistors $Q_2$ and $Q_3$ become on, the transistors $Q_1$ and $Q_4$ becomes off, and the recording current is inverted so as to flow along the path +E, $Q_3$, $R_2$, L, $Q_2$, ground. At this time, the direction of the magnetic field generated from a joint gap portion 23 of the head is shown by the arrow 25. Then, a magnetized pattern 101*a* or 101*b* is recorded on the recording medium 12.

When the direction of the recording magnetic field is changed in such a manner for the first one black dot, magnetization transfer regions 103*a*, 103*b* are formed. Similarly, the magnetized patterns are sequentially formed as shown in FIG. 5. Note that the black region includes at least one magnetized pattern 102*a* directed to the right; in the black region including more two dots, the right-oriented magnetized pattern 102 and the left-oriented magnetized pattern 101 are formed alternately; the white region includes only the left-oriented magnetized pattern 101; and the unit length of the left-oriented magnetized pattern formed in the black regions is significantly shorter than that of the left-oriented magnetized pattern formed in the white region.

Returning to FIG. 3, at this state, the magnetic field generates from the magnetization transfer region to the air, so that the toner is attracted. As shown in FIG. 3(B), a magnetic field having the direction shown by 110*a* is generated from the transfer regions 103*a* and 103*b*, and a magnetic field having the direction shown by 110*b* is generated from the transfer regions 103*b* and 103*c*.

Now, the development under the developing field 37 as shown in FIG. 3(C) will be explained. As the magnetic field 110*a* generated into the air by the magnetized pattern and the developing field 37 due to the developer device magnets 35, 36 have the same direction, these are added vectorically so that the force from the transfer region 103*b* to 103*a* can be increased. As a result of this, the toner 31*a* can be easily attracted between the transfer regions 103*a* and 103*b*. The toner 31*a* shown in FIG. 3(D) protrudes from between the transfer regions 103*a* and 103*b*. This is near the real model due to the reason that the transfer regions have an actual width and the dimension of the toner particles is 10 to 20 μm.

The magnetic field 110*b* generated into the air by the magnetized pattern and the developing field 37 are opposite in direction. Therefore, when these are added vectorically, the force connecting the toners from the transfer region 103*b* to the transfer region 103*c* decreases. As already mentioned, the distance between the two regions is longer than the distance shown in the magnetized pattern, therefore, the force from the transfer region 103*b* to 103*c* is originally weak. As a result of further reducing the amount of the developing magnetic field 37, almost no toner is attracted, as shown in FIG. 3(D), so that a white image is produced.

Next, there are two black dots, the magnetic field 110*c*, 110*e* generated from the right-oriented magnetized patterns 102*b*, 102*c* to the air can be considered the same as the already mentioned 110*a*. The toner is thus attracted forcibly. The direction of the magnetic field 110*d* generated from the magnetized pattern 101*c* is the same as that of the white portion 110*b*, so the attractive force of the toner is weakened by the developing magnetic field 37. However, the distance between the transfer regions 103*d* and 103*e* is considerably shorter than the distace between the transfer regions 103*b* and 103*c*, so the attracting force of the toner is inherently strong. If it is weakened by the developing magnetic field 37, only the amount of the attracted toner decreases (shown in FIG. 3(D)). The image does not become a white image, however, it becomes slightly faint.

When thus toner image is transferred and fixed on the recording paper 47, the toner image spreads as shown in FIG. 3(D). The pulse width of the recording current showing one black dot was considerably narrower than the image signal as shown in FIG. 5(*c*), however, it spreads substantially to one dot in the final print. Further, the amount of the toner 31*c* was smaller than that of the toners 31*b* or 31*d*, however, it becomes average by the transfer and the fixing so there is no problem in appearance.

Next, an explanation will be given as to why the resolution becomes inferior when the polarities of the developing magnets 35, 36 are made opposite so that the developing magnetic field is reversed. This is shown in FIG. 3(F) as the developing magnetic field II, 38. At first, the developing magnetic field 38 and the magnetic field 110*a* generated in the air by the magnetizing pattern 102*a* for forming a first black regions are opposite in direction. The toner attracting force in this portion is thus weakened. At this time, as already explained concerning 110*d*, the distance between the transfer regions 103*a* and 103*b* is short and then the toner attracting power is strong. Thus, even if the power is weakened by the developing magnetic field having the opposite direction, the amount of toner is just somewhat decreased (the toner 31*f* of FIG. 3(G)).

Next, the developing magnetic field 38 and the magnetic field 110*b* generated in the air by the magnetized pattern 102*b* for forming a white area have the same direction, so the toner attracting force in this portion is strengthened. Therefore, the toner is attracted, as shown by the toner 31*g* of FIG. 3(G). With respect to the magnetized patterns 102*b*, 102*c* showing the next black area, the amount of the attracted toner somewhat decreases as with the magnetized pattern 102*a*. The magnetic field in the air formed by the magnetized pattern 101*c* in the black region has the same direction as that of the developing field 38, the toner attracting force is increased, and a considerable amount of the toner 31*i* is attracted. The magnetic field 110*f* generated in the air formed by the magnetized pattern 101*d* for next two white dots is also strengthened, however, the distance is long, so the attracting force is weak. The field is aided by the developing field, so some toner is attracted to form a gray color. In FIG. 3(G), a picture having a very low resolution is formed.

Now, a simple numerical model will be considered. Note that the values are used only for the model and lack precision. For example, it is assumed that the magnetic field 110*a*, 110*c*, 110*d*, 110*e* between the transfer regions having a short distance have a force which can attract 100 toner particles, the magnetic field 110*b* between the transfer regions having a long distance has a force which can attract 30 toner particles, and the further longer magnetic field 110*f* has a force which can attract 10 toner particles. Then, in the case of FIGS. 3(C) and (D), the regions 110*a*, 110*c*, and 110*e* have a force which can attract $100+30=130$ toner particles and the region 110*d* has a force which can attract $100-30=70$ toner particles, whereby toner is attracted to form a black image. The toner attracting force in the region 110*b* is $30-30=0$ and in the region 110*f* is $10-30<0$, so a white image is formed. In the case of FIGS. 3(F) and (G), the regions 110*a*, 110*c*, and 110*e* have a toner attracting force corresponding to $100-30=70$ particles and the region 110*d* has an attracting force corresponding to $100+30=130$ toner particles, so that a black region is formed. The toner attracting force in the regions 110*b* and 110*f* is strengthened even in the regions where white is to be formed, that is, $30+30=60$ particles in the region 110*b* and $10-130=40$ in the region 110*f*, so a black or gray image is formed. Thus, a print having a low resolution is obtained in FIG. 3(G).

In the above, the explanation was given the case referring to when the developing magnetic field was inverted. The same applies, however, when the developing magnetic field is held in the original state and the erasing magnetic field and the recording magnetic field are inverted.

When the magnetized pattern 101 for forming a white image is made sufficiently long, the original force is very weak if only the force due to a developing magnetic field is applied, so almost no toner is attracted in practical. For the purpose of obtaining a print having a high resolution, the present invention is very important. In an experiment, for example, an image having 200 dots/inch could be realized in FIGS. 3(C) and (D), however, could not be realized in FIGS. 3(F) and (G).

When a recording method is used in which a positive or a negative current is made to constantly flow in the coil 22 of the recording head 2, the erasing head is not always necessary. However, when it is desired to erase all of the drum in one stroke, or when one direction is previously recorded by the erasing head and the pulse current is made to flow in only one direction in the recording head, the erasing head is necessary, and the direction of the magnetic field is preferably set as mentioned above.

Figure 6:
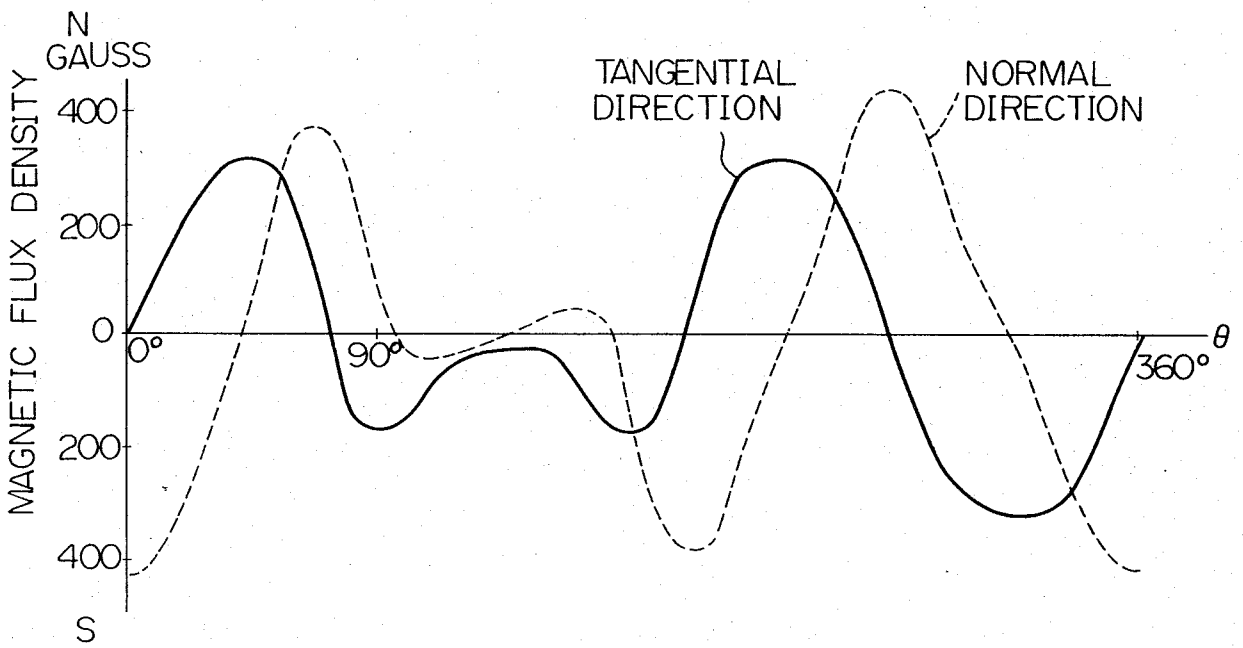
FIG. 6 shows an example of the distribution of the magnetic field of the developer in the method according to the present invention.

FIG. 6 shows one example of the distribution of magnetic field in the developer enabling a print having a good image to be obtained. The magnetic field is measured at the peripheral of the sleeve, and both the tangential direction and the normal direction are shown. The preferable gap between the sleeve 32 and the drum 1 is 1 to 4 mm, more preferably, 1.5 to 3 mm. Further, the peripheral speed of the recording drum 1 is set higher than that of the sleeve 32. It is considered that the differences of these peripheral velocities contribute somewhat to the formation of the image.

As explained above, according to the present invention, a print having a high resolution can be obtained by mutual action between the developing field and the magnetic field generated by the magnetized pattern for the recording.

I claim:

1. Method for recording latent images in a magnetic printing apparatus comprising the steps of:

forming, at one-dot black picture regions on a recording medium, a magnetized pattern of one direction having at least two magnetic transfer regions;

forming, at two- or more- dot black picture regions, beside said magnetized pattern of one direction, at least one magnetized pattern having the other direction;

forming at white picture regions on said recording medium, a magnetized pattern which is longer than said magnetized pattern in said black picture region and which has the other direction, and the direction of developing magnetic field being the same as said other direction.

2. Method according to claim 1, wherein when said recording medium is erased, direct current magnetization is carried out at said other direction.

3. Method for recording and developing latent images in a magnetic printing apparatus comprising the steps of:

forming, at one-dot black picture regions on a recording medium, a magnetized pattern of one direction having at least two magnetic transfer regions;

forming, at two- or more -dot black picture regions, beside said magnetized pattern of one direction, at least one magnetized pattern having the other direction;

forming at white picture regions on said recording medium, a magnetized pattern which is longer than said magnetized pattern in said black picture region and which has the other direction; and developing by the developing magnetic field with the same direction as said other direction.

4. Method according to claim 1, wherein when said recording medium is erased, direct current magnetization is carried out at said other direction.

* * * * *